US005769373A

United States Patent [19]

Bond

[11] Patent Number: 5,769,373

[45] Date of Patent: Jun. 23, 1998

[54] MERCHANDISE DISPLAY HOOK WITH PIVOTABLE, LOCKING BACK PLATE

[75] Inventor: Harold B. Bond, Wilkes-Barre, Pa.

[73] Assignee: Trion Industries, Inc., Wilkes-Barre, Pa.

[21] Appl. No.: 812,727

[22] Filed: Mar. 6, 1997

[51] Int. Cl.[6] ..... A47F 5/00

[52] U.S. Cl. ..... 248/220.41; 211/57.1; 248/221.11

[58] Field of Search ..... 211/57.1, 59.1; 248/220.31, 220.41, 221.11, 222.51, 243

[56] References Cited

U.S. PATENT DOCUMENTS

| | | | |
|---|---|---|---|
| 3,275,272 | 9/1966 | Kirk | 248/220.41 |
| 3,289,993 | 12/1966 | Thalenfeld . | |
| 3,409,260 | 11/1968 | Bleed | 248/220.31 X |
| 3,926,395 | 12/1975 | Lallrement | 248/220.41 |
| 4,351,440 | 9/1982 | Thalenfeld . | |
| 4,436,209 | 3/1984 | Thalenfeld . | |
| 4,474,351 | 10/1984 | Thalenfeld . | |
| 4,516,681 | 5/1985 | Jahel | 248/220.41 X |
| 4,520,978 | 6/1985 | Taub | 211/57.1 X |
| 4,674,721 | 6/1987 | Thalenfeld . | |
| 5,348,167 | 9/1994 | Jensen | 248/220.41 X |

*Primary Examiner*—James R. Brittain

*Attorney, Agent, or Firm*—Schweitzer Cornman Gross & Bondell LLP

[57] ABSTRACT

A merchandise display hook for mounting on an apertured display panel having a wire-like element with a vertical base portion. Upper and lower parallel, spaced-apart cross bars are fixed perpendicular to the base portion and a back plate having lug portions adapted to be inserted into the apertured display panel is pivotally connected to the upper cross bar. The back plate is adapted to lockingly engage the lower cross bar whereby pivoting the back plate allows the straight-in entry of the merchandise display hook and the locking engagement of the back plate to the lower cross bar prevents the rotation of the back plate when under load and provides for the transfer and distribution of forces from the base portion to the back plate.

16 Claims, 3 Drawing Sheets

MERCHANDISE DISPLAY HOOK WITH PIVOTABLE, LOCKING BACK PLATE

BACKGROUND AND SUMMARY OF THE INVENTION

The present invention relates generally to merchandise display hooks, particularly of the type used in connection with apertured panel board merchandise displays.

One form of such a merchandise display hook consists of a normally horizontal wire-like merchandise support element having a vertical base portion rigidly connected to a back plate. The back plate has lug portions which fit through the apertures of the panel board and contact the rear side of the panel board to support the merchandise display hook.

U.S. Pat. No. 4,351,440 to Thalenfeld discloses an improved merchandise display hook which has a back plate arranged to pivot on a cross bar fixed to the base portion of the merchandise hook. This allows the merchandise display hook to be installed on a display panel in a straight-in fashion, whereby only the back plate need be rotated in order to insert the lug portions through the panel apertures. Therefore, the wire-like merchandise support can remain perpendicular to the panel board so as to permit mounting and removal of the merchandise display hook in a confined area. As disclosed in U.S. Pat. No. 3,289,993 to Thalenfeld, such a pivoting back plate is beneficial because it obviates the need for substantial overhead clearance when mounting and removing the merchandise display hook. The pivoting back plate also allows for installation and removal without first removing hooks installed thereabove.

In the operation of the above Thalenfeld designs, the wire-like merchandise support element is directly supported by the cross bar pivot of the back plate and by the panel board. The cross bar pivot confines and supports the cross bar (attached to the base portion) and the panel board provides an abutment surface for the lower end of the base portion. When weight is applied, the merchandise support element tends to rotate about the cross bar thereby applying increasing amounts of pressure to the panel board via the base portion until a state of equilibrium is achieved. Thus, the cross bar pivot provides all the necessary vertical support for the merchandise support element and the pivot and panel board work in combination to balance the rotating moments created by the weight on the outwardly extending merchandise support element.

The above Thalenfeld designs are significant improvements over the prior art. However, in some applications, such as displays of heavy merchandise (e.g. hammers, shovels, etc.), where the load on the merchandise display hook is significant, it is preferable that the wire-like element, and specifically the base portion thereof, not contact the panel board directly. It is often desirable that the sometimes large forces applied to the panel board by the base portion be distributed over a relatively larger surface so as to avoid damage or deformation of the panel board.

A merchandise hook disclosed in U.S. Pat. No. 4,674,721 to Thalenfeld is particularly appropriate for such applications. This design includes a back plate having a bearing panel which engages the base portion of the wire-like merchandise support element and distributes the forces exerted by the base portion over a relatively large area of the apertured panel. The back plate disengages from the wire-like element to enable the back plate to be inserted into the panel board first. The wire-like merchandise support element is attached in a second step. This design provides for an effective distribution of forces applied by the base portion of the wire-like element and is therefore more appropriate for displays of heavy items. However, it is often desirable that the back plate of the merchandise display hook be permanently connected to the wire-like element for security and safety reasons and to reduce installation time and cost.

In view of the above, the novel and beneficial features of the present invention can be appreciated. The device of the present invention comprises a wire-like merchandise support element having two cross bars fixed perpendicular to the vertical base portion. A back plate, having lug portions, adapted to be inserted through apertures in a panel board, is pivotally connected to one of the cross bars and is lockingly engageable with the other cross bar. In addition, the back plate includes abutment flanges for transferring and distributing all forces from the wire-like support element to the panel board. In operation, the device of the present invention is similar to the device disclosed in U.S. Pat. No. 4,351,440 to Thalenfeld in that the back plate pivots outwardly on a cross bar attached to the base portion. However, the present design differs in that the back plate is somewhat loosely pivotally connected to the first cross bar and there is a second cross bar attached to the base portion to which the back plate lockingly engages. Specifically, the back plate includes a first pair of pivot slots which allow the back plate to pivot on and move with respect to an upper cross bar. The back plate also includes a pair of locking slots having entry and locking sections adapted to engage a lower cross bar.

To mount the merchandise display hook of the present invention, the back plate is pivoted perpendicular to the panel board and the lug portions are inserted into the apertures in a known manner. The back plate is then rotated downward about the upper cross bar such that the ends of the lower cross bar enter the locking slots. The base portion and cross bars are then moved downward until the ends of the lower cross bar enter the closed ends of the locking slots. In this position, the wire-like element is firmly locked to the back plate and any weight supported by the wire-like element will be transmitted to the panel board solely by the back plate and its abutment flanges. Thus, no force will be applied by the wire-like element or its base portion directly to the apertured panel board. To remove the merchandise display hook, the process is reversed.

Another advantageous feature of the invention is its resistance to being pulled out of the panel board improperly. Prior merchandise display hooks with pivoting back plates can in some cases, with some amount of force, be pulled or yanked out of the panel board improperly. When the wire-like support element of prior designs is pulled, the back plate can rotate about the cross bar thereby partially aligning the lug portions with the apertures. With a sufficient amount of force, the lug portions can then be pulled through the apertures. The device of the present invention eliminates this possibility because, when in the locked position, the back plate cannot rotate about the upper cross bar. To remove the present merchandise display hook, the wire-like support element must first be properly disengaged from the locking slots of the back plate by moving the hook element upward with respect to the back plate. Then the back plate can be rotated outwardly and upwardly to withdraw the lug portions from the panel board.

The inability of the back plate to rotate also avoids another possible situation which could occur with a merchandise display hook having a relatively long merchandise support arm. The situation could arise when the length of the merchandise support arm is a large multiple of the base portion thereby creating a moment at the back-plate/base-portion connection that is very large compared to the total weight of the suspended items. This could result in the back plate spontaneously rotating outwardly and the merchandise support arm rotating downwardly, possibly discharging the suspended items. The present invention avoids this by locking the back plate against rotation, as discussed above. Furthermore, such rotation is prevented regardless of the forces present at the inward end of the wire-like element.

Thus, the present invention provides for the distribution of forces applied to the panel board while maintaining the above described benefits of a permanently attached, pivoting back plate. Also, it can be appreciated that the invention provides a merchandise display hook which is easy to install and remove, suitable for heavy merchandise, secure, and inexpensive to manufacture.

BRIEF DESCRIPTION OF THE DRAWING

For a more complete understanding of the above and other features and advantages of the invention, reference should be made to the following detailed description of the preferred embodiment of the invention and to the accompanying drawings, wherein.

DETAILED DESCRIPTION OF THE INVENTION

Figure 1:
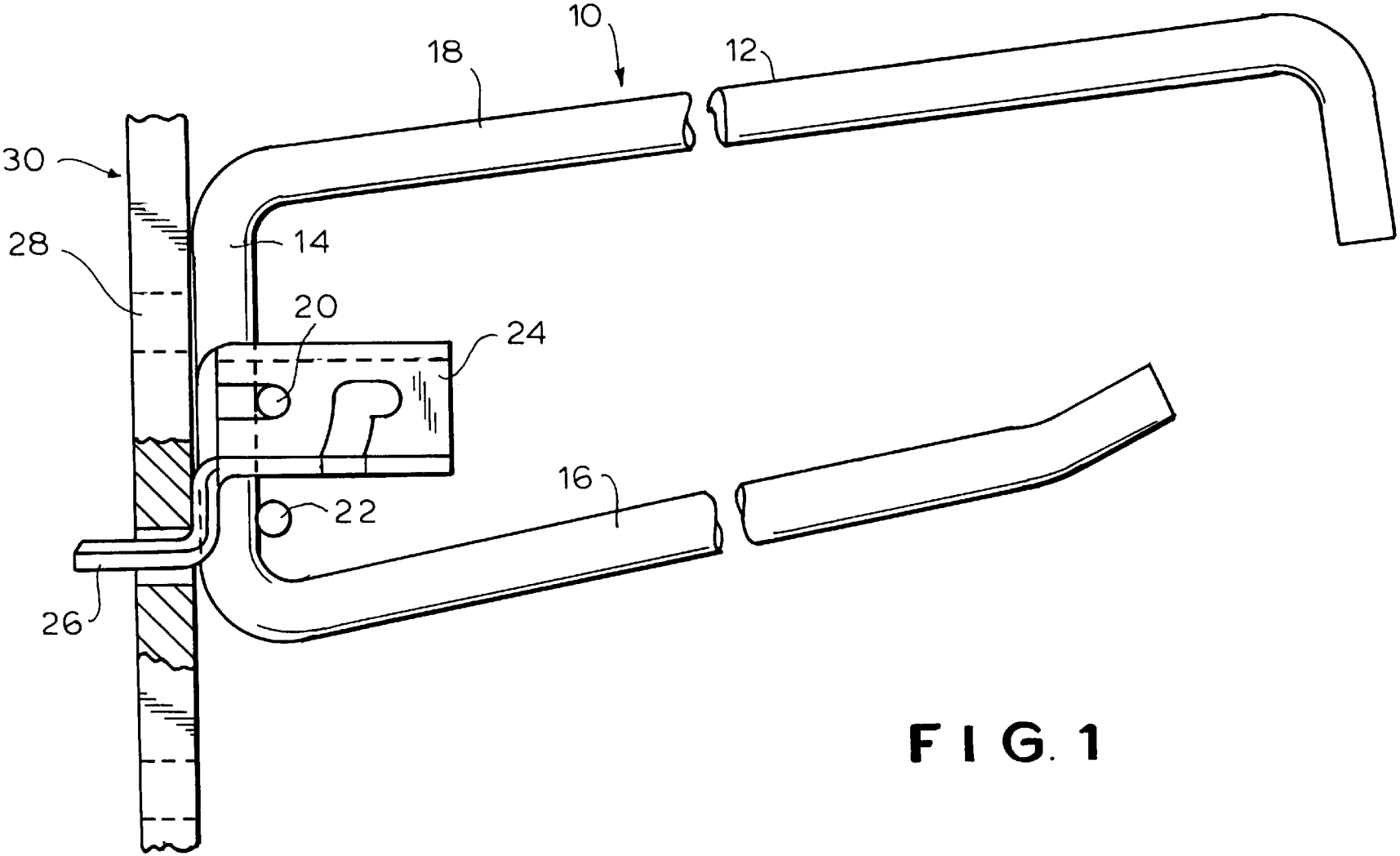
FIG. 1 is a side view of the merchandise display hook of the present invention, showing the back plate in a pivoted position for insertion into a panel board.

Referring now to the drawing, and initially to FIG. 1 thereof, a preferred embodiment of the merchandise display hook 10 of the present invention includes a wire-like element 12, having a base portion 14 and a merchandise supporting arm 16. The wire-like element 12 also preferably includes a safety arm 18 extending over and above the merchandise support arm 16. However, as can be appreciated, the safety arm 18 is not required, and in fact, the merchandise support arm 16 could be in the position of the safety arm 18. Upper and lower cross bars 20, 22 are fixed to the base 14 in parallel, spaced relation to one another, typically by welding. A back plate 24, having lug portions 26, is pivotally connected to the upper cross bar 20.

As shown, the back plate 24 is pivotable about the upper cross bar 20 to align the lug portions 26 with the apertures 28 of a panel board 30 for mounting and removal of the merchandise display hook 10. As described in the prior art, the pivoting movement of the back plate 24 allows the merchandise display hook 10 to be mounted and removed while maintaining the wire-like element 12 in a substantially perpendicular relationship to the panel board 30.

Figure 2:
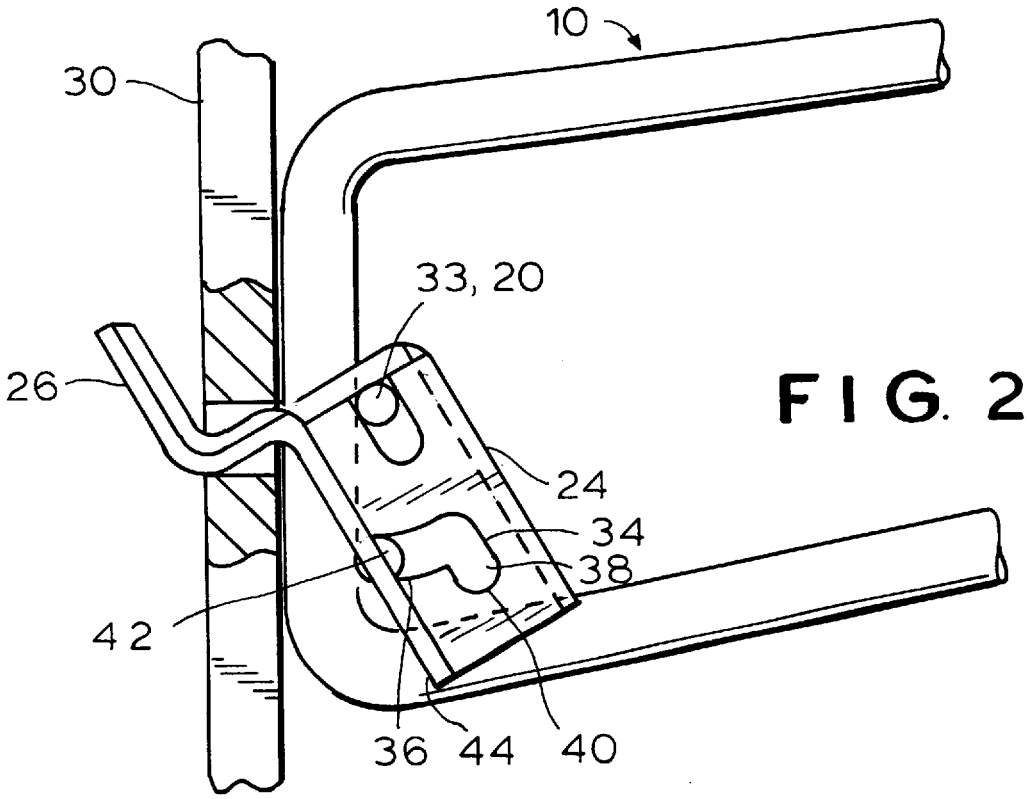
FIG. 2 is a closeup side view of the merchandise display hook of FIG. 1, showing the back plate pivoted toward the aperture panel during mounting.

Referring to FIG. 2, the back plate 24, which may be formed of sheet metal, preferably includes a pair of pivot slots 32 which confine opposite ends 33 of the upper cross bar 20 such that the back plate 24 can pivot and move relative to the cross bar 20. The back plate 24 also preferably includes a pair of locking slots 34 each having an entry section 36, a locking section 38 and a closed end 40. The locking sections 38 are preferably aligned parallel to the pivot slots 32 and can also be axially aligned therewith, as shown. In mounting the merchandise display hook 10, the back plate 24 is pivoted about the upper cross bar 20 such that the lug portions 26 rotate into the panel board 30 and such that opposite ends 42 of the lower cross bar 22 enter the entry sections 36 of the locking slots 34. In addition, the back plate 24 includes abutment flange surfaces 44 aligned to contact the panel board 30.

Figure 3:
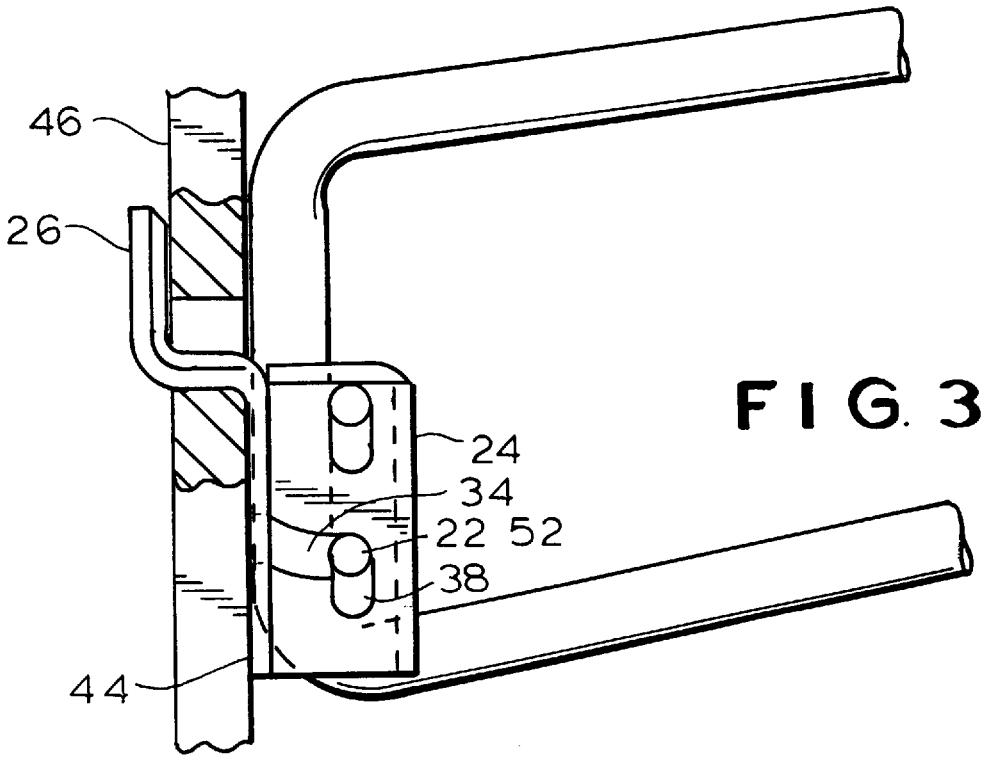
FIG. 3 is a closeup side view of the merchandise display hook of FIG. 1, showing the back plate pivoted in alignment with the apertured panel board.

Referring to FIG. 3, when rotation of the back plate 24 is complete, the abutment flange surfaces 44 of the back plate 24 are in contact with the panel board 30, the lug portions 26 are in contact with the rear surface 46 of the panel board 30, and the opposite ends 42 of the lower cross bar 22 are aligned with the locking portions 38 of the locking slots 34.

Figure 4:
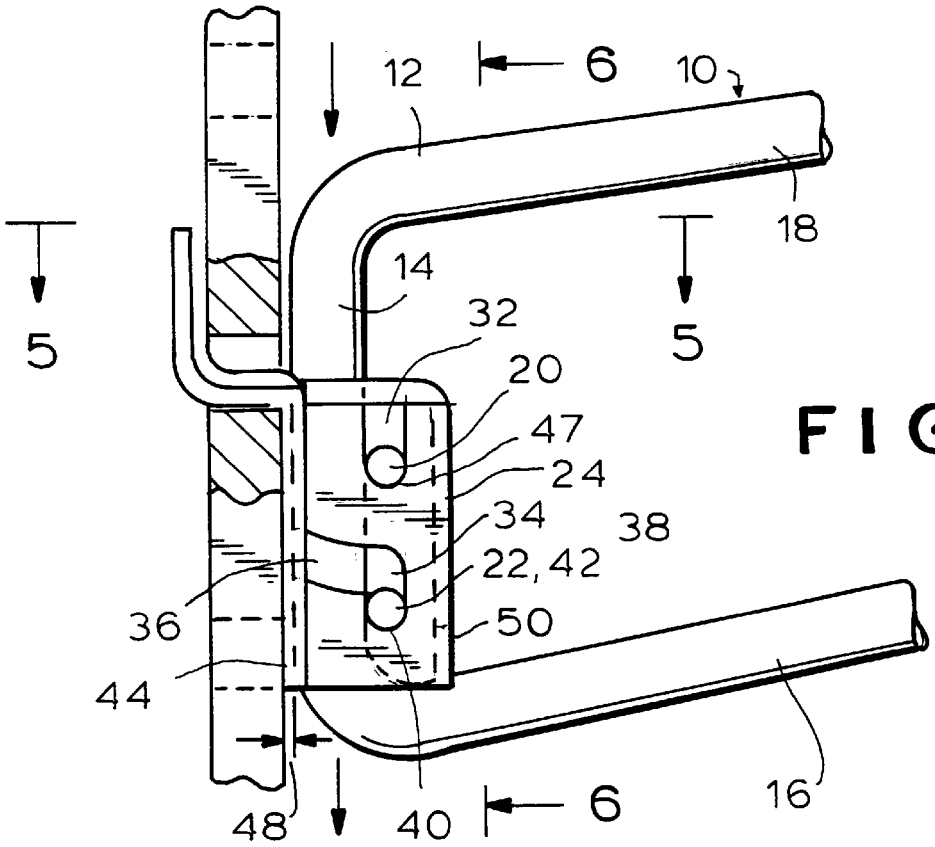
FIG. 4 is a closeup side view of the merchandise display hook of FIG. 3, showing the base portion of the hook lockingly engaged with the back plate.
Figure 5:
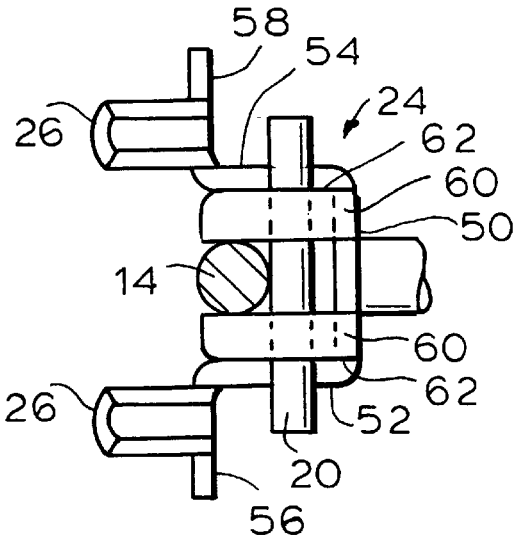
FIGS. 5 and 6 are cross sectional views taken generally through lines 5—5 and 6—6 respectively of FIG. 4.
Figure 6:
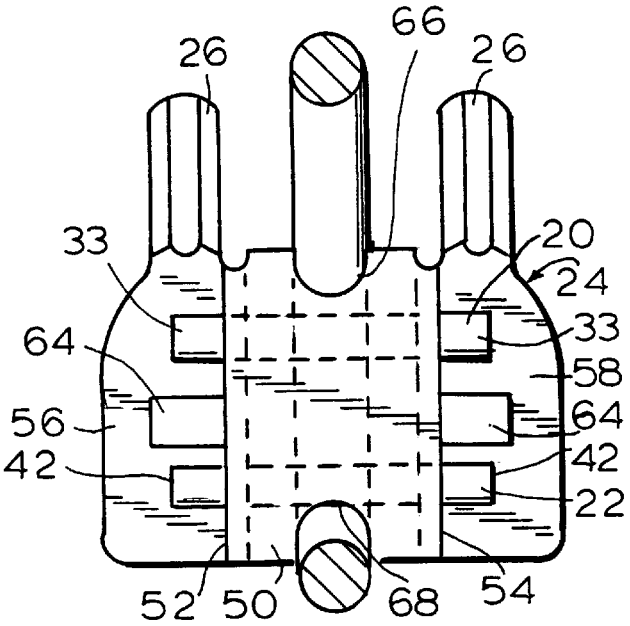

Referring to FIGS. 4, 5 and 6, in the final step of mounting, the wire-like support element 12 is moved downwardly with respect to the back plate 24 such that the ends 33 of the upper cross bar 20 move to the bottom 47 of the pivot slots 32 and such that the ends 42 of the lower cross bar 22 move down into the locking sections 38 of the locking slots 34 and abut the closed ends 40 thereof.

When in the position described above, the back plate 24 is lockingly engaged to the wire-like support element 12 (and vice versa) and neither can pivot with respect to the other. As can be appreciated, when a downward force is applied to either the safety arm 18 or the merchandise support 16 arm, further rotation of the wire-like support element 12 or back plate 24 about the upper cross bar 20 is prevented by the interaction between the back plate 24 and the lower cross bar 22. Thus, the possibilities of instability or improper removal are avoided. Also, preferably a small clearance 48 exists between the base portion 14 of the wire and the juncture of the panel board 30 and the abutment flanges 44 of the back plate such that all forces applied to the wire-like support element 12 will be transmitted to the panel board 30 only through the back plate 24 and, specifically, the force-distributing abutment flange surfaces 44 thereof. Thus, it can be appreciated that the wire-like support element 12 and the back plate 24 of the present invention can support a substantial amount of weight without damaging or deforming the panel board 30.

The cooperation of cross bars and locking back plate 24 also provides another advantageous feature of the present invention, namely that the merchandise display hook 10 can safely have a wire-like element 12 with a merchandise support arm 16 that is relatively long compared to the vertical base 14 and which can support a substantial load at the end thereof. With such a configuration, the moment at the back-plate/base-portion connection can be very large compared to the total weight of the suspended items. In the absence of a locking back plate, the (outward) torque created by the outwardly-directed component of the force exerted on the back plate by the lone cross bar could exceed the opposed (inward) torque created by the downwardly-directed component of the same force. If this occurred, the back plate could spontaneously rotate outwardly about the cross bar thereby partially aligning the lug portions with the apertures. This could result in the merchandise support arm rotating downwardly, possibly discharging the suspended items. The present invention avoids this situation by preventing the rotation of the back plate, as discussed above. Furthermore, such rotation is prevented regardless of the forces present at the inward end of the wire-like element.

The back plate 24 is preferably formed from sheet metal and includes a front panel 50, two side walls 52, 54 and a pair of abutment flanges 56, 58 extending laterally from the side walls 52, 54. The lug portions 26 project upwardly from the abutment flanges 56, 58 and are shaped to fit through and engage the back wall 46 of the panel board 30.

The side walls 52, 54 are substantially identical and, as mentioned above, include pivot slots 32 and locking slots 34 formed therein. A pair of arms 60 connected to the front panel 50 extend adjacent upper edges 62 of the side walls 52, 54 and define the upper boundaries of the pivot slots 32 thereby confining the upper cross bar 20. The arms 60 also confine the wire base portion centrally with respect to the side walls 52, 54.

Preferably, the abutment flanges include passageways 64 aligned with the entry sections 36 of the locking slots 34 such that the opposite ends 42 of the lower cross bar 22 can pass therethrough. Also, the front panel 50 preferably includes upper and lower recesses 66, 68 which accommodate the merchandise support arm 16 and the safety arm 18, respectively, when the back plate 24 moves vertically relative thereto during mounting and removal.

Thus, it can be appreciated that the merchandise hook 10 of the present invention provides the benefits of a pivoting, locking and force-distributing back plate 24 which is permanently attached to the wire-like merchandise support element 12. The merchandise display hook 10 thus can be configured with a relatively long merchandise display arm 16 for supporting relatively heavy items and can be easily mounted and removed from the panel board 30 without disturbing other hooks mounted thereon. Further, the merchandise display hook 10 can be manufactured in an inexpensive manner and delivered preassembled, in one piece such that it can be installed with minimal effort and cost.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A merchandise hook for mounting on an apertured display panel, which comprises:

(a) a wire-like element having a vertical base portion;

(b) first and second parallel, spaced-apart cross bars fixed perpendicular to said base portion;

(c) a back plate pivotally connected to said first cross bar, said back plate being adapted to releasably lockingly engage said second cross bar;

(d) said back plate having lugs adapted to be inserted into said apertured display panel and to engage a back side thereof for mounting said merchandise hook;

(e) whereby pivoting said back plate allows for the straight-in entry of said merchandise hook and whereby said locking engagement of said back plate with said second cross bar provides a stable connection between said back plate and said wire-like element.

2. The merchandise hook as in claim 1 wherein said back plate further comprises:

(a) a pair of pivot slots adapted to confine opposite ends of said first cross bar such that said back plate can pivot relative to said base portion and such that said back plate can move relative to said base portion in a direction parallel thereto; and (b) a pair of locking slots adapted to lockingly engage opposite ends of said second cross bar.

3. The merchandise hook as in claim 2, wherein:

(a) each locking slot has an entry section with an opening aligned to accept an end of said second cross bar when said back plate is pivoted toward said base portion; and (b) each locking slot has a locking section with a closed end, said locking section being aligned substantially parallel and pair of pivot slots;

(c) whereby said base portion can be lockingly engaged to said back plate by pivoting said back plate about said first cross bar such that said ends of said second cross bar enter said entry sections of said locking slots and then translating said base portion relative to said back plate such that said ends of said second cross bar enter said locking sections of said locking slots adjacent the closed ends thereof.

4. The merchandise hook as in claim 3 wherein said back plate further comprises abutment surfaces adapted to engage said display panel for the distribution of forces applied to said display panel.

5. The merchandise hook of claim 4 wherein, when said back plate is lockingly engaged to said base portion, a clearance exists between said base portion and said abutment surfaces such that, when mounted, said base portion normally does not contact said display panel.

6. The merchandise hook as in claim 1 wherein said back plate further comprises abutment surfaces adapted to engage said display panel for the distribution of forces applied to said display panel.

7. The merchandise hook of claim 6 wherein, when said back plate is lockingly engaged to said base portion, a clearance exists between said base portion and said abutment surfaces such that, when mounted, said base portion does not normally contact said display panel.

8. A merchandise hook for mounting on an apertured display panel, which comprises:

(a) a wire-like element having a vertical base portion and a merchandise support arm;

(b) a back plate pivotally connected to a cross bar attached to said base portion;

(c) said back plate having lugs adapted to be inserted into said apertured display panel and to engage a back side thereof for mounting said merchandise display hook;

(d) said back plate being pivotal between a first position substantially perpendicular to said base portion and a second position substantially parallel to said base portion; and (e) means to releasably lockingly engage said back plate to said base portion when in said second position;

(f) whereby pivoting said back plate allows for the straight-in-entry of said merchandise hook and whereby said releasable locking engagement of said back plate to said base portion provides a stable connection to said base panel regardless of the length of the merchandise support arm.

9. The merchandise hook as in claim 8 wherein said back plate pivots outwardly with respect to said base portion such that a free end of said back plate is closest to an outward end of said merchandise support arm when said back plate is in said first position.

10. The merchandise hook as in claim 9 wherein said back plate further comprises:

(a) first and second parallel, spaced-apart cross bars fixed perpendicular to said base portion;

(b) a pair of pivot slots adapted to confine opposite ends of said first cross bar such that said back plate can pivot relative to said base portion and such that said back plate can move relative to said base portion in a direction parallel thereto; and (c) a pair of locking slots adapted to lockingly engage opposite ends of said second cross bar.

11. The merchandise hook as in claim 10, wherein:

(a) each locking slot has an entry section with an opening aligned to accept an end of said second cross bar when said back plate is pivoted toward said base portion; and (b) each locking slot has a locking section with a closed end, said locking section being aligned substantially parallel to said pair of pivot slots;

(c) whereby said base portion can be lockingly engaged to said back plate by pivoting said back plate about said first cross bar such that said ends of said second cross bar enter said entry sections of said locking slots and then translating said base portion relative to said back plate such that said ends of said second cross bar enter said locking sections of said locking slots adjacent the closed ends thereof.

12. The merchandise hook as in claim 11 wherein said back plate further comprises abutment surfaces adapted to engage said display panel.

13. The merchandise hook as in claim 9 wherein said back plate further comprises abutment surfaces adapted to engage said display panel.

14. The merchandise hook of claim 12 wherein, when said back plate is lockingly engaged to said base portion, a clearance exists between said base portion and said abutment surfaces such that, when mounted, said base portion does not normally contact said display panel.

15. The merchandise hook of claim 13 wherein, when said back plate is lockingly engaged to said base portion, a clearance exists between said base portion and said abutment surfaces such that, when mounted, said base portion does not normally contact said display panel.

16. A merchandise hook for mounting on an apertured display panel, which comprises:

(a) a wire-like element having a vertical base portion and a merchandise support arm;

(b) a back plate pivotally attached to said base portion;

(c) said back plate having lugs adapted to be inserted into said apertured display panel and to engage a back side thereof for mounting said merchandise display hook;

(d) said back plate being pivotal between a first position substantially perpendicular to said base portion and a second position substantially parallel to said base portion;

(e) means to releasably lockingly engaging said back plate to said base portion when in said second position;

(f) said back plate being outwardly pivotal with respect to said base portion such that a free end of said back plate is closest to an outward end of said merchandise support arm when said back plate is in said first position;

(g) first and second parallel, spaced-apart cross bars fixed perpendicular to said base portion;

(h) a pair of pivot slots adapted to confine opposite ends of said first cross bar such that said back plate can pivot relative to said base portion and such that said back plate can move relative to said base portion in a direction parallel thereto; and (i) a pair of locking slots adapted to lockingly engage opposite ends of said second cross bar, (j) whereby pivoting said back plate allows for the straight-in-entry of said merchandise hook and whereby said releasable locking engagement of said back plate to said base portion provides a stable connection to said base panel regardless of the length of the merchandise support arm.

* * * * *